United States Patent [19]

O'Dea et al.

[11] Patent Number: 4,541,827

[45] Date of Patent: Sep. 17, 1985

[54] CARTON UNFOLDING APPARATUS

[75] Inventors: James D. O'Dea, Oxford; Glen J. Venable, Fenton, both of Mich.

[73] Assignee: General Motors Corporation, Detroit, Mich.

[21] Appl. No.: 439,764

[22] Filed: Nov. 8, 1982

[51] Int. Cl.[4] ..... B31B 1/78

[52] U.S. Cl. ..... 493/309; 53/566

[58] Field of Search ..... 53/566; 493/309

[56] References Cited

U.S. PATENT DOCUMENTS

| | | | |
|---|---|---|---|
| 1,195,937 | 8/1916 | Wills | 493/309 |
| 3,007,293 | 11/1961 | McGihon . | |
| 3,420,036 | 1/1969 | Hutchinson | 53/566 |
| 3,619,966 | 11/1971 | Goldsberry . | |

*Primary Examiner*—Leon Gilden

*Attorney, Agent, or Firm*—Edward J. Biskup

[57] ABSTRACT

An apparatus for unfolding a flattened carton that includes a flat support platform and a pivotable plate member each of which is provided with a stop member that can be adjusted in position relative to the other stop member so as to permit the apparatus to accommodate flattened cartons of varying widths.

2 Claims, 8 Drawing Figures

CARTON UNFOLDING APPARATUS

The present invention relates to an apparatus for unfolding a flattened cardboard carton comprised of a plurality of hingedly interconnected panels so as to reposition the panels relative to each other and thereby form a box which can protect an article during shipping.

In order to conserve space and for ease of handling, it is customary for carton manufacturers to supply cartons varying in size and shape in a "collapsed" or flattened condition to ultimate users—such as packing outlets and parts distribution centers. As a result, after the cartons are received by the user, it becomes necessary to unfold or "open" the flattened carton prior to insertion of the part or article to be packaged. The present invention provides an apparatus which performs the unfolding of the flattened carton and includes adjustable means for permitting the apparatus to accommodate flattened cartons of varying sizes.

More specifically, the apparatus made according to the present invention comprises a generally rectangular base frame providing a horizontal support platform bounded by a pair of side edges interconnecting a front edge to a rear edge. A plate member is pivotally connected to the rear edge of the base frame for movement between a first position wherein the plate member is horizontally aligned with the support platform of the base frame, and a second position wherein the plate member is located in a substantially vertically oriented plane. A stop or bar member, extending the length of the plate member, is supported by the plate member for adjustable positioning relative to the rear edge of the support platform. A similar bar or stop member, extending the length of the support platform, is supported by the base frame for adjustable positioning relative to the rear edge of the support platform. Thus, by moving one or both of the bar members towards or away from the rear edge of the support platform, the apparatus is allowed to accommodate a flattened carton of varying width between the two bar members when the plate member is located in the horizontal position. After the flattened carton to be unfolded is placed on the support platform of the base frame between the two bar members, a power-operated actuator pivotally connected between the plate member and the base frame serves to move the plate member to the vertical position causing the side edges of the flattened carton to be moved toward each other by the two bar members resulting in a separation of the cardboard panels of the carton and the formation of a tubular box.

The objects of the present invention are: to provide a new and improved apparatus for unfolding a flattened carton; to provide a new and improved apparatus which supports a flattened carton between a pair of stop members, one of which is adapted to rotate about a horizontal axis towards the other stop member to compress the flattened therebetween and thereby cause the hinged panels of the carton to be repositioned relative to each other and form a tubular box; to provide a new and improved apparatus for unfolding a flattened carton that includes a flat support platform and a pivotable plate member, each of which is provided with a stop member that can be adjusted in position relative to the other stop member so as to permit the apparatus to accommodate flattened cartons having hingedly interconnected panels of varying widths; and to provide a new and improved apparatus for forming a flat carton comprising interconnected cardboard panels into a tubular container by forcing the opposite side edges of the carton towards each other and thereby separating the panels to form the flat carton into a tubular box.

These and other objects and advantages of the present invention will be apparent from the following detailed description taken in conjunction with the accompanying drawings, in which.

Figure 1:
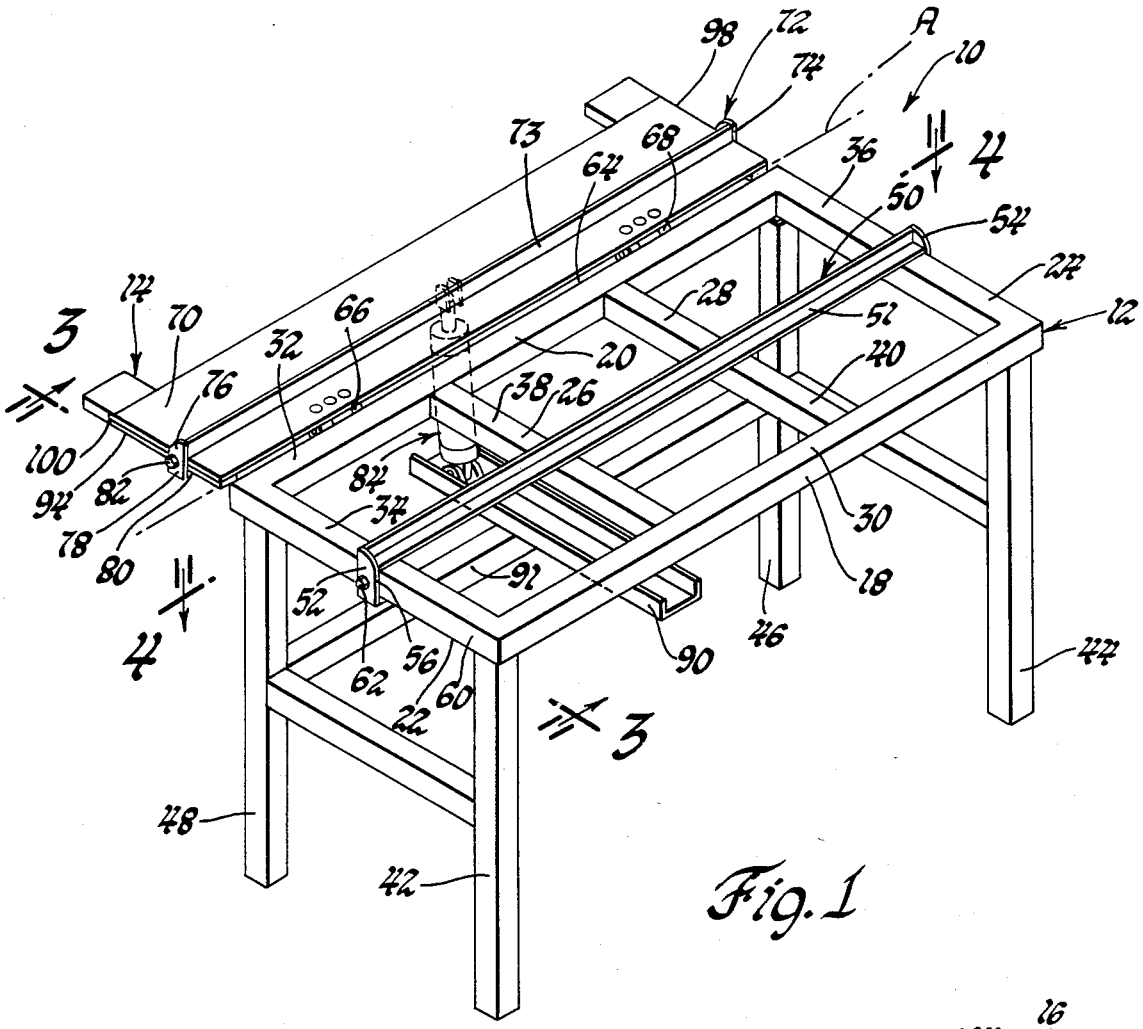
FIG. 1 is a perspective view of the carton unfolding apparatus made in accordance with the present invention.
Figure 2:
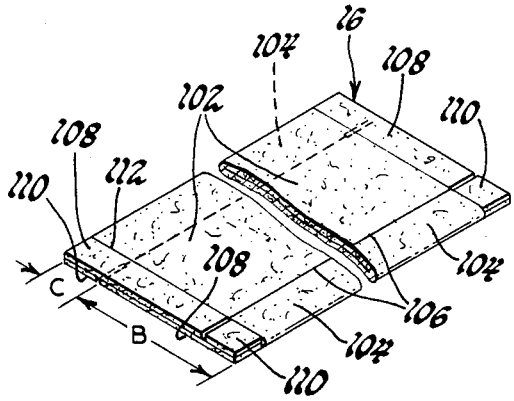
FIG. 2 is a perspective view of a flattened carton prior to being unfolded by the apparatus of FIG. 1 to form a tubular box.
Figure 3:
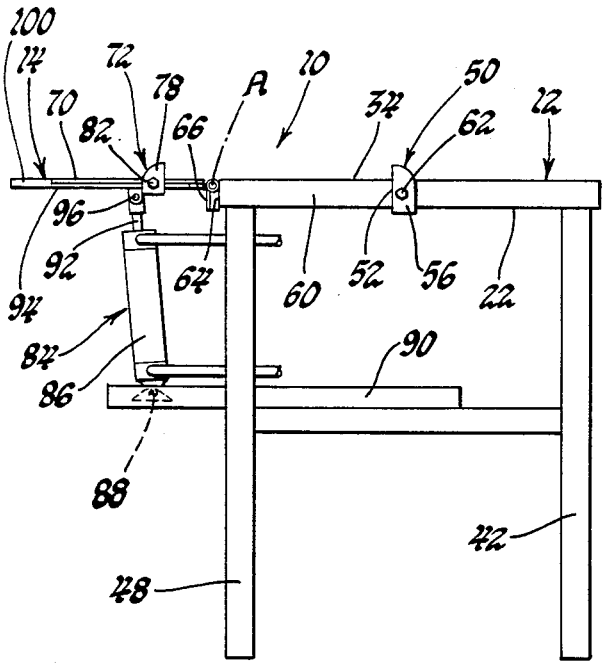
FIG. 3 is a side elevational view of the apparatus taken on line 3—3 of FIG. 1.
Figure 4:
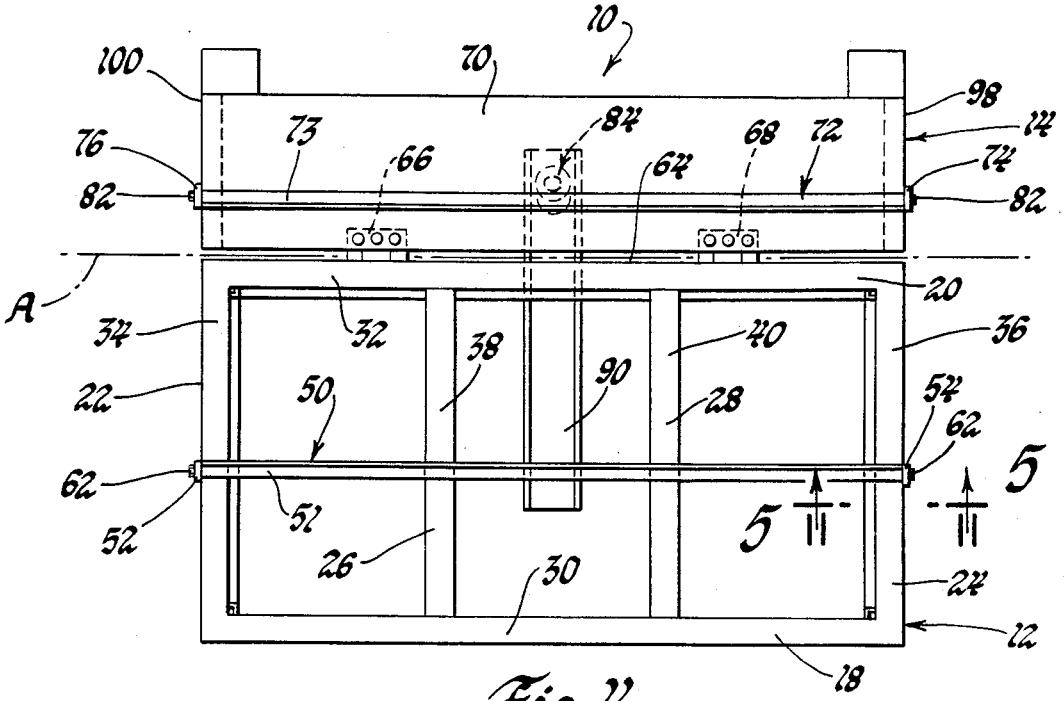
FIG. 4 is a plan view of the apparatus taken on line 4—4 of FIG. 1.

Referring to the drawings and more particularly FIGS. 1, 3, and 4 thereof, a carton unfolding apparatus 10 is shown which, in general, includes a rectangular base frame 12 and a pivotable plate member 14 which together serve to support and unfold a flattened carton 16 (shown in FIG. 2) in a manner to be hereinafter described.

More specifically, the base frame 12 is composed of respective front and rear beam members 18 and 20 which are interconnected at their ends by side beam members 22 and 24. A pair of intermediate beam members 26 and 28 are equally spaced from the side beam members 22 and 24 and extend between the front and rear beam members 18 and 20. The upper surfaces 30, 32, 34, 36, 38, and 40, of the front beam member 18, rear beam member 20, side beam members 22 and 24, and intermediate beam members 26 and 28, respectively, form a support platform located in a common horizontal plane. The support platform thus formed is supported by four (4) upstanding leg members 42, 44, 46, and 48 which are rigidly connected to the base frame 12 at the four (4) corners thereof.

Figure 5:
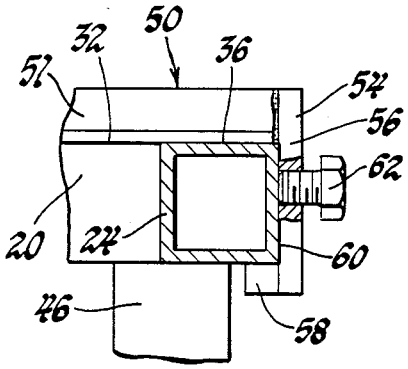
FIG. 5 is an enlarged sectional end view of one of the bar members incorporated in the apparatus and taken on line 5—5 of FIG. 4.

A stop member 50 extends between the side beam members 22 and 24 and includes an elongated bar 51 in the form of an angle iron connected to a pair of slidable guide members 52 and 54 which allow the stop member 50 to be manually adjustably movable relative to the base frame 12. As seen in FIG. 5, each of the guide members 52 and 54 comprises a vertically oriented plate 56 and a rigidly connected foot 58, the former of which contacts the outer side edge 60 of the associated side beam member and the latter of which is located below the associated side beam member so as to maintain the bar 51 in surface contact with the support platform of the base frame 12. A screw 62 is screw-threaded into a bore formed in each guide member 52 and 54, and when tightened against the associated side beam member, serves to secure the stop member 50 in an adjusted position on the base frame 12 relative to the rear edge 64 of the rear beam member 20. When each screw 62 is loosened, the stop member 50 can be repositioned towards or away from the rear edge 64 of the rear beam member 20 in parallel relationship with the rear edge 64.

Figure 6:
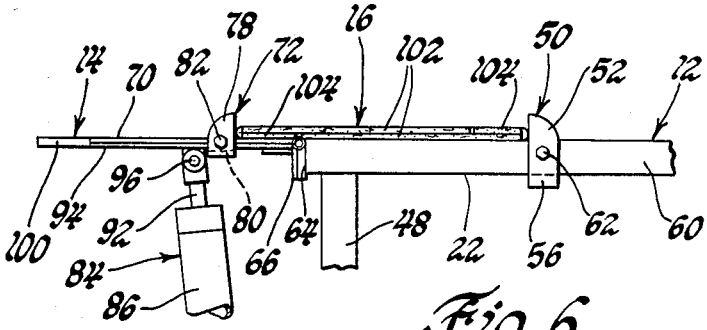
FIG. 6 is a view showing the plate member located in a horizontal position, with the flattened carton of FIG. 2 supported between the bar members.
Figure 8:
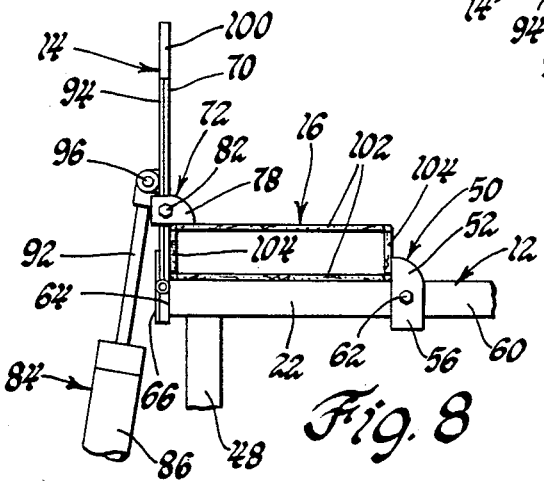
FIG. 8 is a view showing the plate member fully raised to a vertical position and the carton of FIG. 2 formed into a rectangular box.

The plate member 14 is connected to the rear edge 64 of the rear beam member 20 by a pair of hinges 66 and 68 which permit the plate member to be moved about a horizontal axis A (FIGS. 1,3,4) between a lowered horizontal position, shown in FIGS. 1, 3, and 6, and a raised vertical position shown in FIG. 8. When the plate member 14 is located in a lowered horizontal position, the upper flat surface 70 of the plate member 14 is located in the aforesaid common plane which forms the support platform of the base frame 12. The plate member 14 is also provided with a stop member 72 which is identical in construction to the stop member 50 associated with the base frame 12. The stop member 72 includes an elongated bar or angle iron 73, the opposite ends of which are secured to a pair of guide members 74 and 76—each of which has a vertically oriented plate 78 rigidly formed with a foot 80. As in the case with the stop member 50, the foot 80 serves to maintain the bar 73 in surface contact with the flat upper surface 70 of the plate member 14. Each guide member 74 and 76 also includes a screw 82 which serves to secure the stop member in position on the plate member 14 in the same manner as the screws 62 of stop member 50. In addition—and as in the case with the stop member 50 on the base frame 12, the stop member 72 on the plate member 14 can be manually adjusted in position relative to the rear edge 64 of the rear beam member 20 when the screw 82 associated with each of the guide members 74 and 76 is loosened.

In order to move the plate member 14 between the aforementioned lowered horizontal position and the raised vertical position, a double-acting air cylinder 84 is provided—the cylinder portion 86 of which is connected by a pivotal connection 88 to a channel member 90 fixed to a beam 91 extending between the legs 46 and 48. The piston rod portion 92 of the air cylinder 84 is connected to the lower surface 94 of the plate member 14 by a pivotal connection 96 which, as seen in FIG. 4, is located midway between the parallel side edges 98 and 100 of the plate member 14.

Referring now to FIG. 2, the flattened carton 16 is shown prior to being unfolded by the apparatus 10 described above. In the folded condition, the carton 16 comprises a pair of juxtaposed plies of the usual corrugated cardboard material used in making cartons. Each ply comprises carton end and side-forming panels having end-flaps hingedly attached thereto and extending from each end thereof. As is conventional, attachment of the end-flaps to the panels is provided by scored connections. As seen in FIG. 2, the side-forming panels and end-forming panels of the carton 16 are designated respectively by the reference numerals 102 and 104 and are hingedly interconnected by longitudinally extending scored connections 106. The end-flaps attached to the side edges of the side panels and end panels 102 and 104 of the carton 16 are designated respectively by the reference numerals 108 and 110 and are joined to the panels 102 and 104 by a transversely extending scored connection 112.

In operation, the stop members 50 and 72 of the apparatus 10 are initially moved to the appropriate positions relative to the rear edge 64 of the rear beam member 20 to accommodate the flattened carton to be unfolded. Afterwards, the screws associated with each of the guide members of the stop members 50 and 72 are tightened. Thus, in the unfolding operation of the flattened carton 16, the stop member 50 is first located relative to the rear edge 64 a distance equal to the width dimension B of the side panel 102 as seen in FIG. 2. Then the stop member 72 will be located from the rear edge 64 of the rear beam member 20 a distance equal to the width dimension C of the end panel 104.

Figure 7:
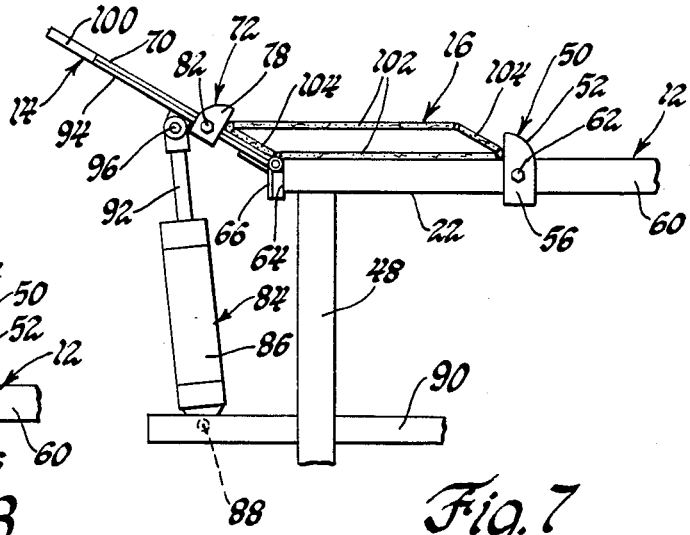
FIG. 7 is a view of the plate member raised to an intermediate position and the carton of FIG. 2 partially unfolded.

After the stop members 50 and 72 are properly located relative to the base frame 12 and the plate member 14, the plate member is placed in the lowered horizontal position of FIGS. 1 and 3, and the flattened carton 16 is placed on the apparatus 10 between the stop members 50 and 72, as seen in FIG. 6. The base-end of the cylinder portion 86 of the air cylinder 84 is then connected to a source of compressed air (not shown) causing the piston rod portion 92 to move out of the cylinder portion 86 and raise the plate member 14 to the FIG. 7 intermediate position, and then to the fully-raised vertical position of FIG. 8. During this upward movement of the plate member 14, the carton is compressed between the stop members 50 and 72 causing the panels 102 and 104 to separate and assume the rectangular cross-sectional configuration seen in FIG. 8. A part to be shipped can then be inserted into the unfolded carton 16, the end-flaps 108 and 110 folded over in the usual manner and sealed so as to complete the packaging.

Various changes and modifications can be made in the construction of this apparatus without departing from the spirit of the invention. Such changes and modifications are contemplated by the inventors, and they do not wish to be limited except by the scope of the appended claims.

The embodiments of the invention for which an exclusive property or privilege is claimed are defined as follows:

1. An apparatus adapted to support a carton having a plurality of hingedly interconnected panels in a flattened condition and to open said carton so as to cause said panels to form a box into which an article can be inserted, said apparatus comprising a generally rectangular base frame providing a flat support surface bounded by a pair of side edges interconnecting a front edge to a rear edge; a plate member pivotally connected to said rear edge of said base frame for movement between a first position wherein said plate member is horizontally aligned with said support surface of said base frame and a second position wherein said plate member is located in a substantially vertically oriented plane; a first stop member and a second stop member each supported for adjustable movement relative to said rear edge of said base frame and mounted respectively on said flat support surface of said base frame and on said plate member so as to permit cartons of varying widths to be positioned between said first and second stop members when said plate member is in said first position; each of said stop members comprising an elongated bar member rigidly connected at its opposite ends to a guide member which serves to maintain said bar member in surface contact with the associated flat surface; and a power-operated actuator pivotally connected between said plate member and said base frame for moving said plate member to said second position so as to cause said carton when in said flattened condition and located between said first and second stop members to be compressed therebetween and formed into said box.

2. An apparatus adapted to support a carton having a plurality of hingedly interconnected panels in a flattened condition and to open said carton so as to cause said panels to form a tubular box into which an article can be inserted, said apparatus comprising a generally rectangular base frame providing a horizontal support surface bounded by a pair of side edges interconnecting a front edge to a rear edge; a plate member having a flat surface, means pivotally connecting said plate member to said rear edge of said base frame for movement between a first position wherein said plate member is horizontally aligned with said support surface of said base frame and a second position wherein said plate member is located in a substantially vertically oriented plane; a first stop member and a second stop member each supported for adjustable movement relative to said rear edge of said base frame and mounted respectively on said support surface of said base frame and on said flat surface of said plate member so as to permit cartons of varying widths to be positioned between said first and second stop members when said plate member is in said first position; each of said stop members comprising an elongated bar member rigidly connected at its opposite ends to a guide member, said guide member including a vertically oriented plate and a horizontally projecting foot which serves to maintain said bar member in surface contact with the associated flat surface; and a power-operated cylinder pivotally connected between said plate member and said base frame for moving said plate member to said second position so as to cause said carton when in said flattened condition and located between said first and second stop members to be compressed therebetween and formed into said tubular box.

* * * * *